US007117554B2

(12) United States Patent
Pichon

(10) Patent No.: US 7,117,554 B2
(45) Date of Patent: Oct. 10, 2006

(54) LATERAL TRANSMISSION CASING FOR A SELF-PROPELLED RUNNING APPARATUS FOR CLEANING A IMMERSED SURFACE

(75) Inventor: Philippe Pichon, Villeneuve de Riviere (FR)

(73) Assignee: Zodiac Pool Care Europe, (FR)

( * ) Notice: Subject to any disclaimer, the term of this patent is extended or adjusted under 35 U.S.C. 154(b) by 430 days.

(21) Appl. No.: 10/450,907

(22) PCT Filed: Dec. 11, 2001

(86) PCT No.: PCT/FR01/03934

§ 371 (c)(1),
(2), (4) Date: Jun. 19, 2003

(87) PCT Pub. No.: WO02/50389

PCT Pub. Date: Jun. 27, 2002

(65) Prior Publication Data

US 2004/0025269 A1 Feb. 12, 2004

(30) Foreign Application Priority Data

Dec. 21, 2000 (FR) ..... 00 16786

(51) Int. Cl.
*E04H 4/16* (2006.01)

(52) U.S. Cl. ..... 15/1.7; 15/50.3

(58) Field of Classification Search ..... 15/1.7, 15/387, 404, 400, 398, 402, 397, 49.1, 50.1, 15/50.3, 52.1, 384, 385; 210/169
See application file for complete search history.

(56) References Cited

U.S. PATENT DOCUMENTS

| | | | | |
|---|---|---|---|---|
| 5,435,031 | A | 7/1995 | Minami et al. | |
| 5,569,371 | A * | 10/1996 | Perling | 210/85 |
| 6,155,657 | A | 12/2000 | Erlich et al. | |
| 6,299,699 | B1 * | 10/2001 | Porat et al. | 134/6 |

FOREIGN PATENT DOCUMENTS

| | | |
|---|---|---|
| EP | 0 314 259 | 1/1992 |
| EP | 0 990 749 | 4/2000 |
| FR | 2 584 442 | 1/1987 |
| WO | WO 99/63185 | 12/1999 |

* cited by examiner

*Primary Examiner*—Gladys J P Corcoran
*Assistant Examiner*—Shay L. Balsis
(74) *Attorney, Agent, or Firm*—Dean W. Russell; Kilpatrick Stockton LLP

(57) ABSTRACT

A lateral transmission casing (6) for a self-propelled running swimming pool cleaner, comprises a housing, an input shaft provided with elements for removable coupling with a clutch shaft (2) of the apparatus, at least an output shaft provided with elements for removable coupling with a running member (13, 14) of the apparatus, elements for transmitting the powering rotary movement between the input shaft and each output shaft, the housing bearing and guiding the shafts and the transmission elements. Detachable mounting elements enable the casing to be rigidly and removably fixed (6) into a single-piece assembly on the side of the apparatus. The invention also concerns an apparatus equipped with such a casing (6), and its maintenance method.

35 Claims, 6 Drawing Sheets

Figure 1:
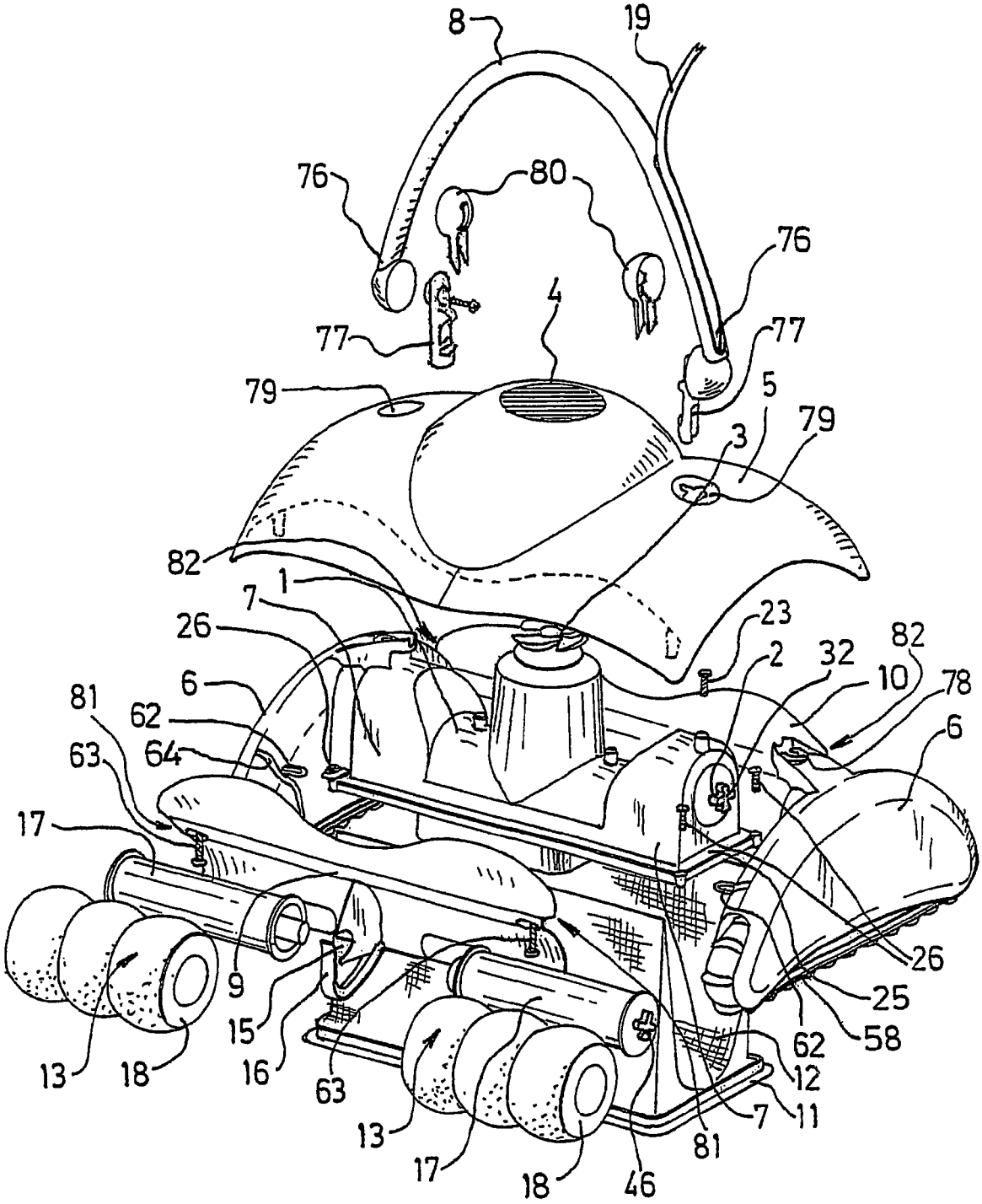

LATERAL TRANSMISSION CASING FOR A SELF-PROPELLED RUNNING APPARATUS FOR CLEANING A IMMERSED SURFACE

The invention relates to a transmission device for a self-propelled rolling apparatus for cleaning a surface submerged in a liquid, in particular a swimming pool. It extends to a self-propelled rolling apparatus for cleaning a surface submerged in a liquid, in particular a swimming pool, the apparatus being provided with at least one transmission device according to the invention.

Some swimming pool-cleaning apparatuses are of the running type, that is to say comprising running members (rolls, wheels, rollers, crawler tracks . . . ) which are rotatable around transverse axes of rotation at least essentially parallel to the rolling plane of the apparatus defined by these running members, corresponding to the surface on which the apparatus moves. Such apparatuses may be self-propelled, that is to say incorporate and bear at least one (electric, hydraulic . . . ) motor driving at least one driving shaft, the rotary movement of which has to be transmitted to at least one running member in order to drive it to rotate.

In one particular known version, to which the invention applies advantageously, the self-propelled apparatus comprises at least one electric motor which is supplied by a watertight electrical cable immersed in the swimming pool and the output shaft (rotor) of which forms a driving shaft. Such a motorised electric apparatus is also generally provided (cf. for example EP-0,314,259, FR-2,584,442, U.S. Pat. No. 5,569,371 . . . ) with an electric pump for the intake of waste and a filtering bag for recovering the waste.

In other known versions to which the invention also applies (for example U.S. Pat. No. 5,435,031, WO-99/63185), the driving shaft can be driven by a hydraulic motor (turbine) and/or by an intake flow of water created by a pumping arrangement outside the swimming pool and connected to the apparatus by a suction pipe.

In most cases, the apparatus operates more or less automatically and is generally referred to as a robot.

In these self-propelled rolling apparatuses, the transmission devices are complex members which often are subject to wear and deterioration, and adversely affect the cost and reliability of the apparatuses. In most cases, for reasons of cost, these transmission devices are of the belt type. In this case, nevertheless, it is known that the distance between centres of the pulleys receiving the belt must be accurate, which arises problems concerning dimensioning and manufacturing accuracy. In fact, the apparatuses are low-cost apparatuses whose manufacturing accuracy must be able to remain low. The belt and/or the pulleys are subject to wear which may lead to a rupture or blockage of the transmission. When belt tighteners are provided, these are costly and require regular adjustments of the belt tension. In addition, the tightened belt has the effect of exerting large radial forces on the bearings of the driving shaft and the running members which, as a result, are also subject to rapid wear, unless costly special runners or bearings are used. These radial forces are even greater when belt tensioners are provided.

Furthermore, in the event of a breakdown of the transmission device, the maintenance is complex and therefore costly. In particular, the changing of a bearing generally requires a complete disassembly of the apparatus, which is relatively time-consuming and costly. During these maintenance operations, the apparatus is unavailable for cleaning the swimming pool.

The object of the invention is therefore to overcome these disadvantages by proposing a simple, reliable, inexpensive transmission device which does not exert radial forces on the bearings of the driving shafts or running members, which can be manufactured with low manufacturing tolerances—in particular similar to those of the other elements of the apparatus and compatible with traditional manufacturing by moulding synthetic material, which requires no regular adjustments and the maintenance of which is easy.

More particularly, the object of the invention is to provide a transmission device which can be easily and quickly replaced in the event of failure.

The object of the invention is more particularly to provide e a transmission device with low susceptibility to wear during operation, and therefore of greater reliability and life-expectancy than the known belt-transmission devices. The object of the invention is also to propose a transmission device which does not require regular adjustments like the belt devices.

The object of the invention is even more particularly to provide a transmission device which is compatible with various shapes and sizes of an apparatus, that is to say allows the production of a range of apparatuses of various shapes and sizes at less cost, having the same transmission devices.

The object of the invention is also to provide a self-propelled rolling apparatus for cleaning a swimming pool—more particularly of the electric motor type—having the same advantages, being simple, inexpensive, reliable, having a long life-expectancy, being inexpensive to manufacture, easy and quick to maintain, and whose operational availability is improved—in particular is little affected by the maintenance operations of the transmission.

To this end, the invention relates to a transmission device for a self-propelled rolling apparatus for cleaning a submerged surface (in particular a swimming pool), intended for transmitting the rotary driving movement of at least one driving shaft, carried by the apparatus, to running members rotatable around transverse axes of rotation in order to drive the apparatus in displacement, which device is formed of a lateral transmission casing comprising:

a rigid housing, an input journal mounted so as to be freely rotatable around an axis of rotation with respect to the housing, and provided with means for demountable coupling to a driving shaft of the apparatus, likewise provided with means for demountable coupling mating with those of the input journal, this input journal being adapted to be coupled to the driving shaft when the casing is mounted on the apparatus, at least one output journal mounted so as to be freely rotatable around a transverse axis of rotation with respect to the housing, and provided with means for demountable coupling to a running member, carried by the apparatus, rotatable around a transverse axis of rotation, outside the casing, the said running member likewise being provided with means for demountable coupling mating with those of the output journal, said output journal being adapted to be coupled to the said running member or to the said drive shaft when the casing is mounted on the apparatus, means for transmission of the rotary driving movement between the input journal and each output journal, the housing bearing and guiding the journals and the transmission means, and demountable mounting means adapted to enable the rigid removable fixing, allowing mounting and demounting, of the casing in a single-piece assembly on one side of the apparatus, the input journal being coupled to a driving shaft and each output journal being coupled to a running member.

Throughout the text, the terms "transverse", "longitudinal" and "lateral" are defined with reference to the normal direction of forward movement of the apparatus on a submerged surface (in particular the bottom, or side wall of a swimming pool).

The device according to the invention comprises a pre-adjusted single-piece casing—that is to say one in which the various constituent elements are adapted, adjusted and optimised regarding their choice, positioning and operation before mounting on the apparatus (in particular for manufacture in a factory or maintenance workshop)—which can be mounted and demounted all in one piece, quickly and simply with respect to the other constituent elements of the apparatus. This design makes it possible to simplify the assembly and the maintenance operations, and to optimise the various elements of the transmission casing in favour of better reliability and a longer service life, at less cost. In addition, the same transmission casing may be used with various apparatus models (shapes, sizes, operation types), without the need for carrying out adjustments or specific machining or assembly operations for each model. It is sufficient to provide the same distance between centres and compatible coupling means on each driving shaft and each running member for the various models.

Advantageously and according to the invention, the transmission means include gear trains—in particular consist of gear trains. More particularly, advantageously and according to the invention, the transmission means comprise a train of successive pinions between the input journal comprising a toothed wheel meshing with one of these pinions, and each output journal, also comprising a toothed wheel meshing with one of these pinions, and each journal and each pinion is mounted in order to be freely rotatable around an axle carried by the housing—in particular integral with the housing, preferably formed by the housing. Advantageously and according to the invention, each train of pinions comprises an uneven number of pinions having the same diameter. Advantageously and according to the invention, all the pinions are identical, thereby enabling a reduction of the manufacturing costs. The train of pinions then has a transmission ratio of 1. In a variant, there is nothing to prevent the provision of a transmission ratio different from 1 (gear reduction or demultiplication) or a reversal of the direction of rotation.

Advantageously and according to the invention, all the input and output journals may also be formed of identical components, thereby also enabling the reduction of the manufacturing costs. In this case, the transmission means as a whole have a transmission ratio of 1. Advantageously and according to the invention, all the journals and pinions are rotatable around transverse axes of rotation which are parallel, when the casing is mounted on the apparatus, to those of the running members and of the driving shafts of the apparatus. All the axes of rotation of a casing according to the invention are therefore parallel, thereby simplifying the manufacture thereof.

Advantageously and according to the invention, the housing is formed of two half-shells extending at least substantially perpendicularly to the axes of rotation of the output journals (vertically when the apparatus is rolling on a horizontal surface) and in the longitudinal direction, one on each side of the journals and transmission means, these two half-shells being joined to each other at an overall longitudinal peripheral connection plane. Advantageously and according to the invention, the two half-shells are connected to each other by means of screws and/or bolts passing through the axle of the pinions. This results in particular in better rigidity of these axles and accurate and reliable guidance of the pinions and journals. The transverse axes of rotation may be carried at each end or be defined by each half-shell. In particular, advantageously and according to the invention, the axes of rotation of the pinions are formed by the housing—in particular by either and/or both of the half-shells. In an advantageous embodiment according to the invention, each journal is mounted so as to be freely rotatable with respect to the housing by means of two end bearings, each comprising a cylindrical seat formed by the housing and receiving a ring made of antifriction synthetic material which in turn receives an axial cylindrical extension of the journal.

Furthermore, advantageously and according to the invention, the housing, the journals and the transmission means (in particular the pinions) are made of synthetic material. The housing and/or the journals and/or the transmission means may advantageously be made of in particular injection-moulded synthetic material. A transmission casing according to the invention is advantageously made entirely of synthetic material, with the possible exception of screws, bolts or other rigid assembly means which it includes and which are used to mount it on the apparatus, which may be metallic. These assembly means may also be produced from rigid synthetic material. The casing according to the invention is thus not subject to corrosion, and is light and inexpensive.

Furthermore, advantageously, a transmission device (casing) according to the invention is overall in the shape of an isosceles triangle (shape defined by its rigid housing), and comprises an input journal at its median upper vertex, and an output journal at each of its front and rear lower vertices in order to couple them to front running members and rear running members.

Advantageously and according to the invention, the input journal is adapted to be arranged as an axial extension of the driving shaft when the casing is mounted on the apparatus. Similarly, advantageously and according to the invention, the output journal is adapted to be arranged as an axial extension of the running member when the casing is mounted on the apparatus. In addition, advantageously and according to the invention, the housing is an outer housing receiving, enclosing and enveloping the journals and the said transmission means, protecting them from the outside, and comprises, on the side oriented towards the centre of the apparatus, for each journal, an aperture enabling the coupling of this journal, through the housing, to a driving shaft or to a running member. Advantageously and according to the invention, the means for demountable coupling of each journal are of the type producing the coupling with mating coupling means of the driving shaft or of a running member by simple relative movement into place—in particular of the positive clutch type. The coupling is thus obtained automatically by simple mounting and fixing of the casing to the apparatus.

Furthermore, advantageously and according to the invention, the said demountable mounting means include means for rigid assembly of the housing of the casing with at least one other element of the apparatus—in particular with a transverse central rigid motor housing of the apparatus. Advantageously and according to the invention, the said demountable mounting means include clamping screws and/or bolts. The fixing of the casing is thus simple, accurate, reliable and rigid.

Furthermore, advantageously and according to the invention, the transmission device itself also bears at least one running member of the apparatus, this running member being driven or not by the driving movement. Advantageously and according to the invention, the transmission device comprises a crawler track adapted to be driven to move along by the input journal and form a longitudinal bottom strand for contact with the ground acting as a running member of the apparatus. Thus, the casing according to the invention bears at least one running member driven by the driving movement. In a variant or in combination, it may also bear at least one wheel, roller, roll . . . driven or not by the driving movement.

Advantageously and according to the invention, the crawler track is formed of an endless belt passing around the input journal and each output journal. Advantageously and according to the invention, each journal comprises two parallel flanges and perpendicular to the axis of rotation of the journal, and adapted to form a roller for receiving and driving the crawler track.

In the case, when the transmission means are provided with gear trains, advantageously and according to the invention, the toothed wheel of each journal is interposed between the two flanges. Advantageously and according to the invention, the crawler track comprises inner notches or teeth capable of being inserted between the flanges of the journals. These inner notches or teeth limit the lateral movements of the crawler track and more particularly prevent the crawler track from leaving its normal position. In addition, advantageously and according to the invention, the crawler track is made of flexible synthetic material. It advantageously includes antisliding transverse outer teeth.

The invention extends to a self-propelled running apparatus for cleaning a submerged surface (in particular a swimming pool), comprising at least one driving shaft, running members rotatable around transverse axes of rotation in order to drive the apparatus in displacement, and transmission means for transmitting the rotary driving movement of each driving shaft to each running member, wherein the transmission means comprise at least one transmission device (casing) according to the invention.

Advantageously and according to the invention, the apparatus comprises two transmission devices (casings) according to the invention, one on each side. Advantageously and according to the invention, the apparatus comprising a central transverse rigid motor housing is characterised in that the transmission devices are rigidly fixed to each lateral end of the motor housing respectively, thus forming an overall generally H-shaped, rigid frame, on which the other constituent elements of the apparatus are mounted and fixed.

Advantageously and according to the invention, the apparatus comprises:

- a front transverse wall and a rear transverse wall extending between the two lateral transmission devices at the front and rear and at a distance from the motor housing so as to provide a passage for the water, and to form a bottom opening,
- base, provided with water inlets and adapted to close the bottom opening,
- and a top hood covering the transverse walls, the lateral transmission devices and the motor housing, this hood being provided with a top orifice for the evacuation of water, so that a hydraulic circuit is provided from the inlets of the base, at the front and rear between the transverse walls and the motor housing and between the lateral transmission devices, and up to the orifice of the hood. Advantageously and according to the invention, the motor housing is moulded as close as possible (with just the clearances necessary for the mounting, operation and moulding of the motor housing) around the elements which it contains and has rounded shapes promoting the water circulation.

The motor housing has hydrodynamic shapes and entails only a small loss of load in the pumping of the water. Advantageously and according to the invention, the motor housing comprises an upper central motor having its shaft orthogonal with the running plane and driving a pumping propeller arranged outside the motor housing under the orifice of the hood, this propeller being adapted to generate a flow of water in the apparatus.

In addition, advantageously and according to the invention, the base bears a filter interposed in the water circuit between the inlets of the base and the evacuation orifice of the hood.

Advantageously and according to the invention, the apparatus comprises two independent separate motors, each of these motors having a driving shaft coupled to one of the two transmission devices.

The running members may be wheels, rolls, rollers . . . in one piece or, in a variant, with drive shaft and wear covering(s) (foam(s), brush(es), running strip(s) . . . ). An apparatus according to the invention is advantageously characterised in that it comprises two pairs of independent running members, namely a front pair of running members and a rear pair of running members, the two running members of the same pair being arranged as a coaxial extension of each other, one of them being coupled to one of the two transmission devices, while the other is coupled to the other transmission device. The independent rollers and the independent motors allow the apparatus to be controlled along all straight or curved paths.

In an apparatus according to the invention, all the rotary members for transmitting the driving movement for driving the apparatus are carried by—in particular integrated in

- a demountable lateral transmission casing according to the invention.

Furthermore, advantageously and according to the invention, each driving shaft is rotatable around a transverse axis, and the input journal and the output journals of each transmission device are rotatable around transverse parallel axes, these different axes being at least essentially parallel to a running plane defined by the running members, corresponding to the surface on which the apparatus is to move.

An apparatus according to the invention is thus of simple, rigid, reliable, wear-free, safe and economical design. It is easy to maintain and requires no adjustment. It is easy and economical to modify its hydraulic or design features, in particular by adapting the shape of the front and rear transverse walls and/or of the top hood.

The invention extends to a method for maintaining (servicing or repairing) of an apparatus according to the invention, wherein:

- at least one lateral transmission casing, called a deficient casing, on which a maintenance operation is to be carried out, is demounted from the apparatus,
- a transmission casing in working order is mounted on the apparatus, in place of each deficient casing, to render the apparatus operational. A maintenance operation is carried out on each deficient transmission casing when it is demounted from the apparatus. In a variant, it is even possible to consider the transmission casings as disposable elements, that is to say they are discarded when they are deficient. Advantageously and according to the invention, immediately after demounting at least one deficient casing, a different new transmission casing in working order is mounted, as a replacement of each previously demounted deficient casing, so that the apparatus is immediately rendered operational.

The invention also relates to a transmission device, an apparatus, and a maintenance method characterised in combination by some or all of the features mentioned above or below.

Figure 2:
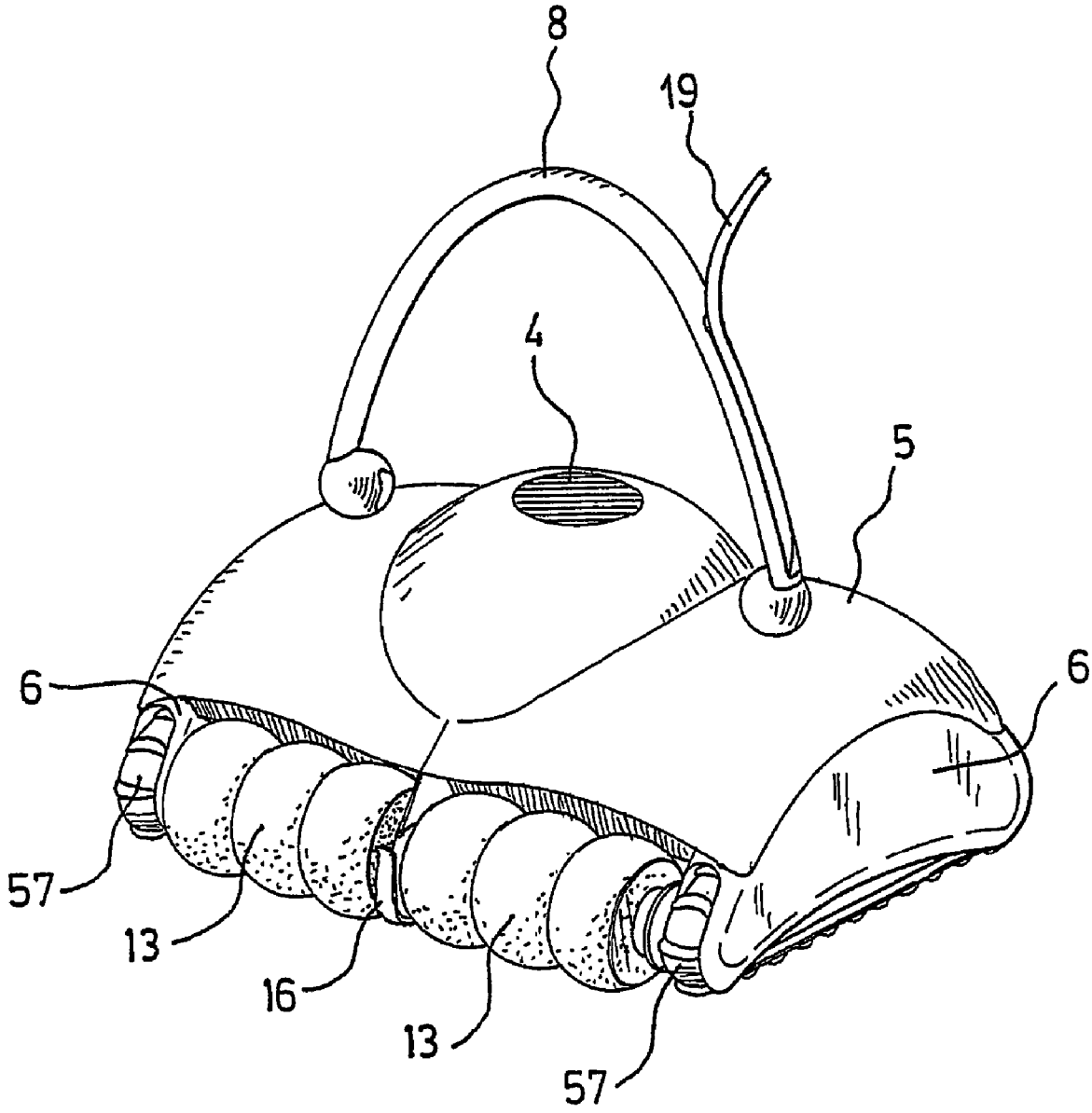
Figure 3:
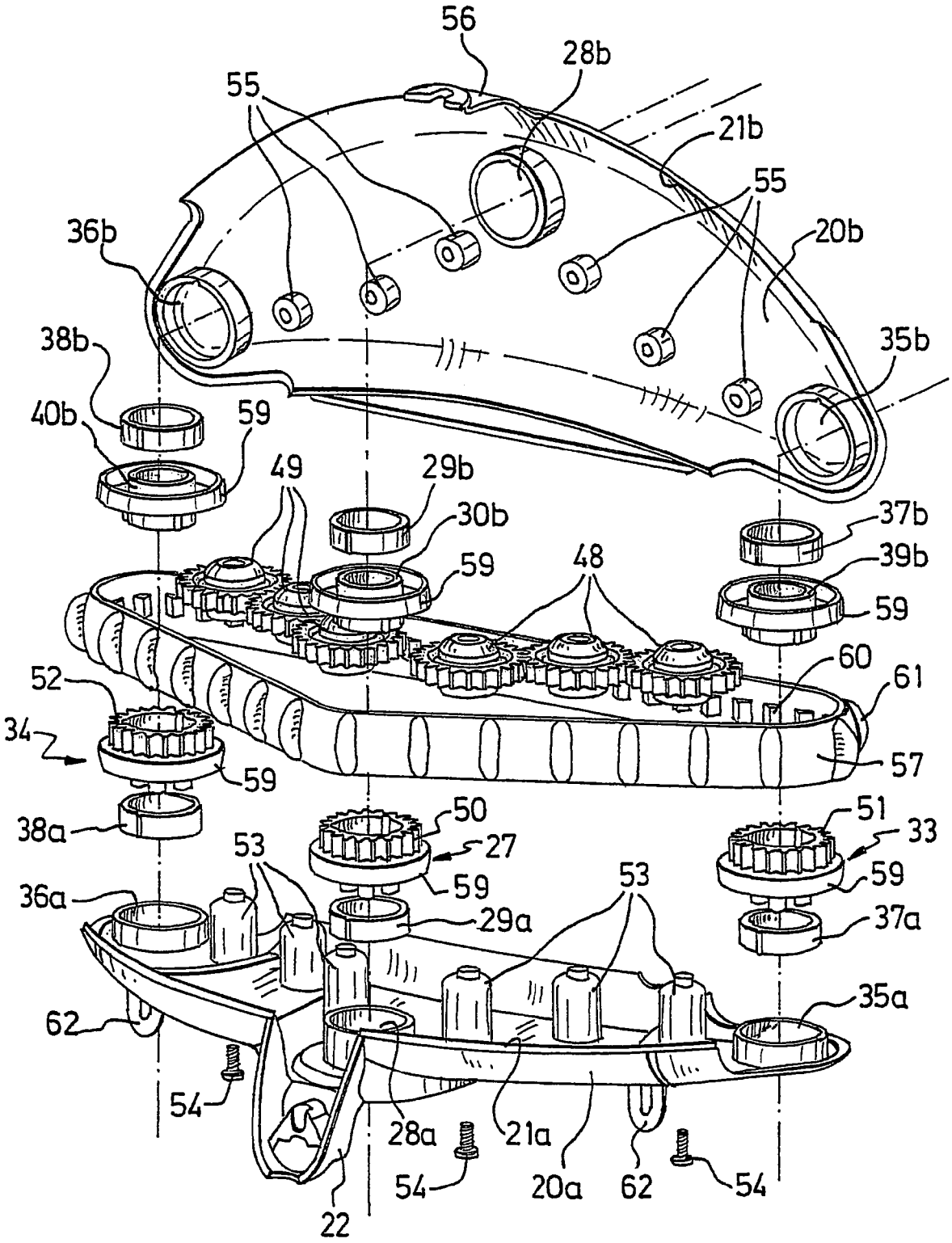
Figure 4:
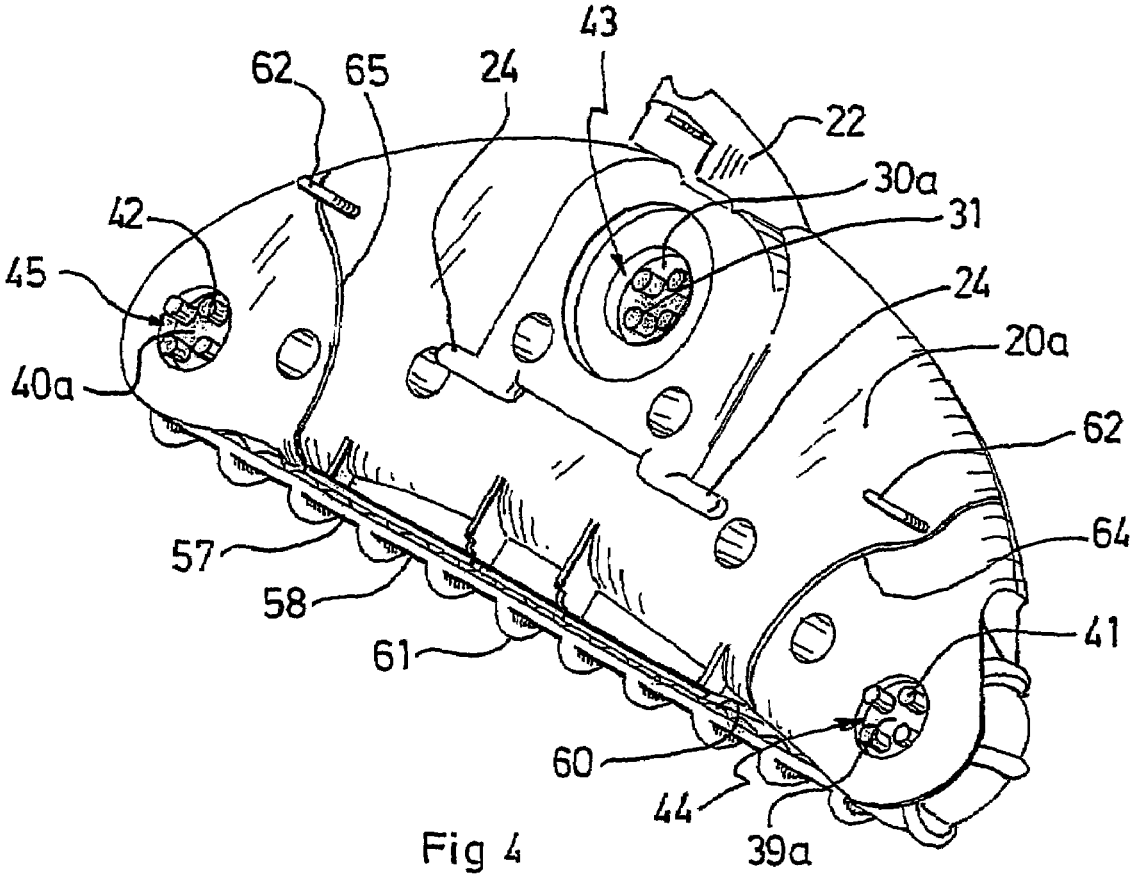
Figure 5:
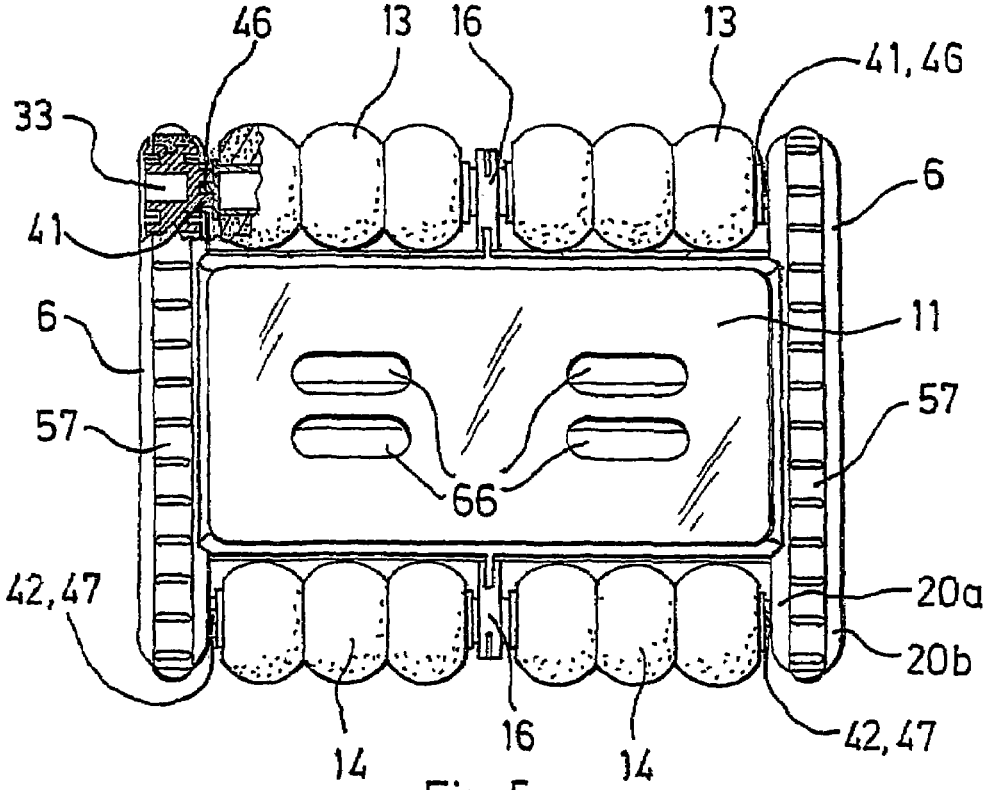
Figure 6:
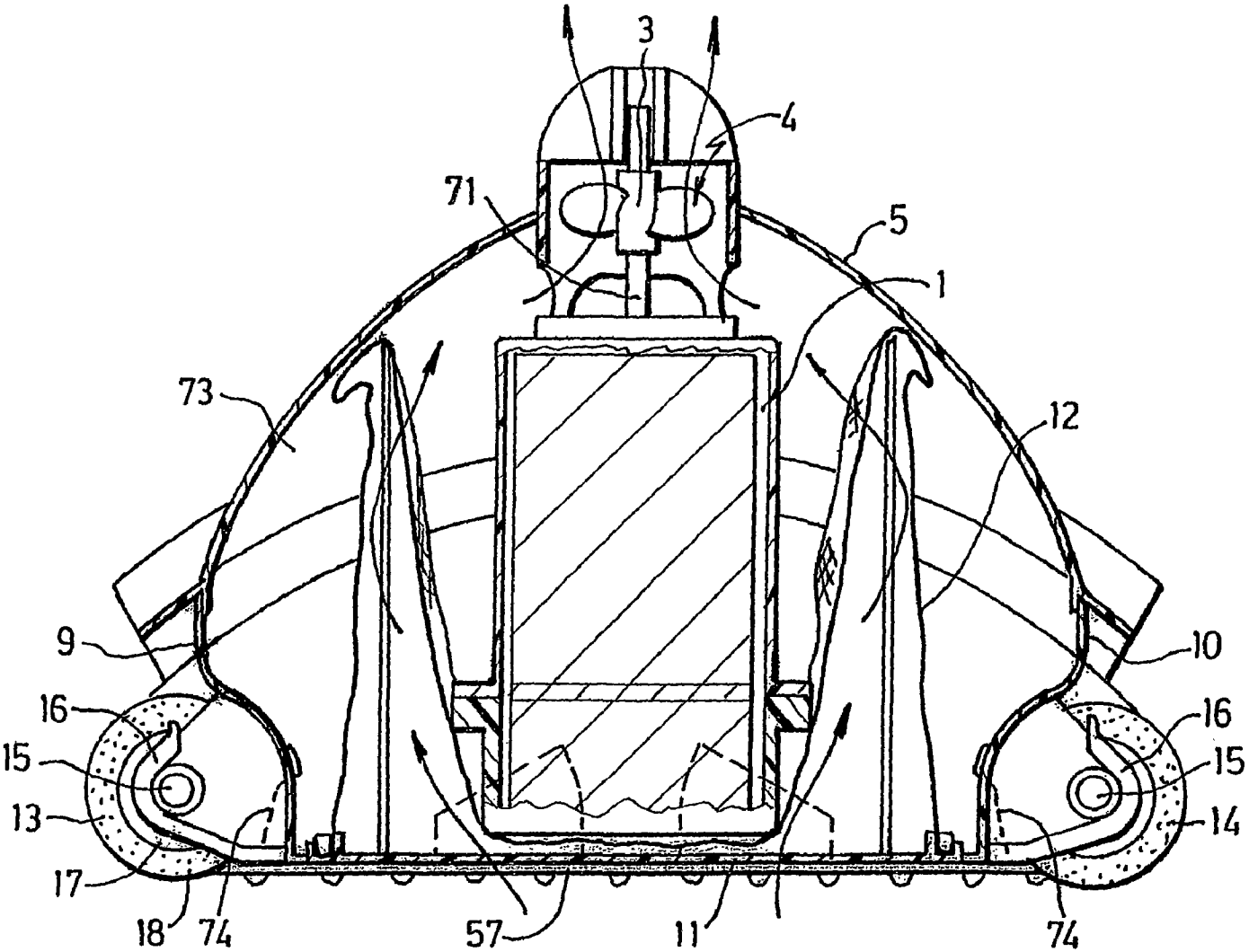
Figure 7:
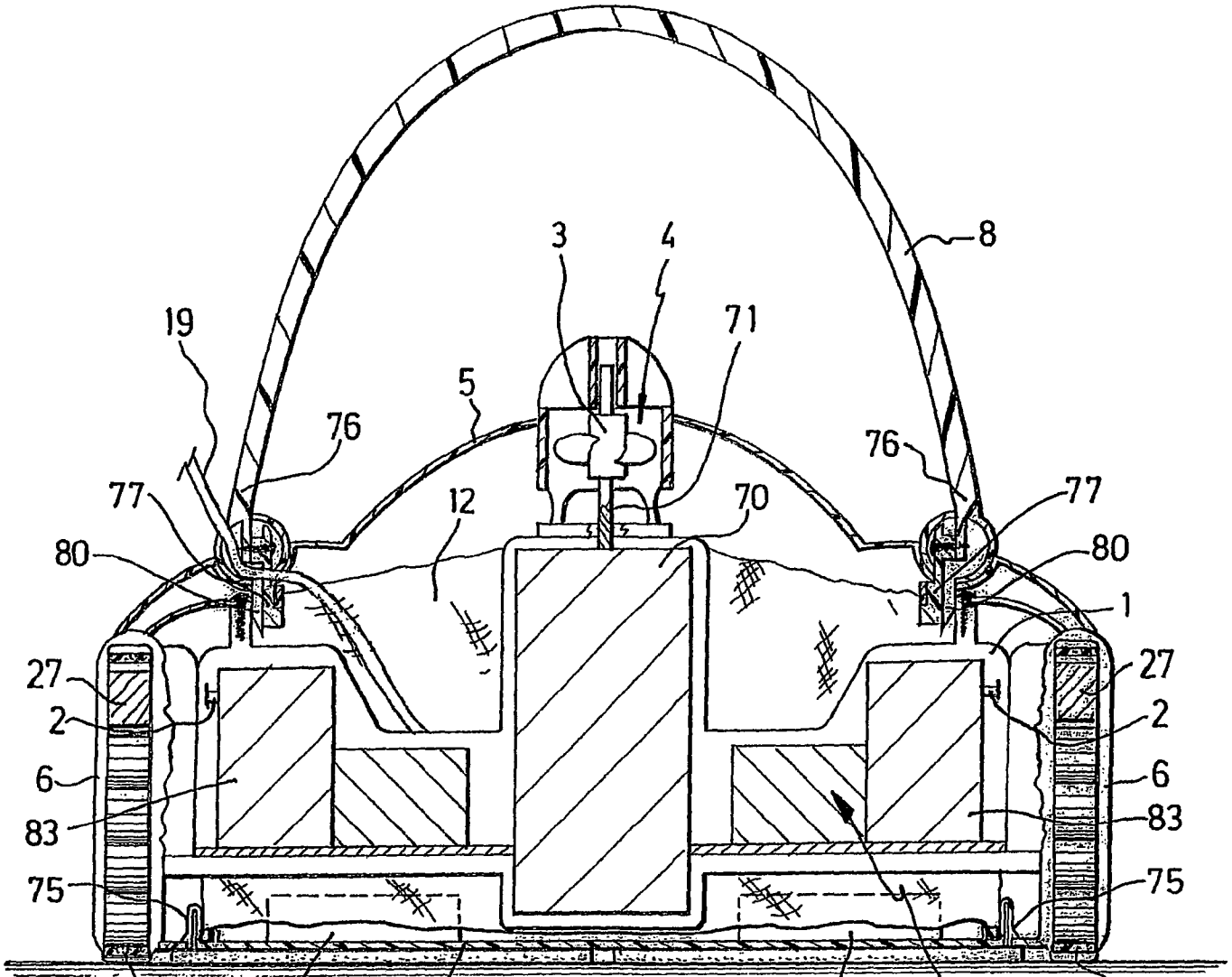

Other objects, features and advantages of the invention will become apparent on reading the following description of an exemplary embodiment shown in the figures, in which:

FIG. 1 is a schematic exploded perspective view of an apparatus according to a preferred embodiment of the invention, FIG. 2 is a schematic perspective view of the apparatus of FIG. 1 in the assembled state, FIG. 3 is a schematic exploded perspective view of a transmission casing according to the invention, FIG. 4 is a schematic perspective view of the casing of FIG. 3 in the assembled state, FIG. 5 is a schematic bottom view at a partial section of the apparatus of FIG. 2, FIG. 6 is a schematic transverse vertical sectional view of the apparatus of FIG. 1, FIG. 7 is a schematic longitudinal vertical sectional view of FIG. 1.

FIGS. 1 and 2 show an electric self-propelled running apparatus (or robot) according to the invention, for cleaning a submerged surface, in particular a swimming pool, comprising a central transverse rigid motor housing 1 made of rigid synthetic material enclosing two similar independent electric motors 83, one on each side, each driving a transverse rotary driving shaft 2 which emerges, projecting laterally, outside the motor housing 1. In its central part, the motor housing 1 encloses a third electric motor 70 whose drive shaft, called the pumping shaft 71, emerges vertically upwards outside the motor housing 1 for driving an upper pumping propeller 3 outside the motor housing 1.

The apparatus according to the invention also comprises two lateral transmission casings 6 according to the invention, one on each side. Each transmission casing 6 is fixed rigidly but demountably, in a single-piece assembly, to each lateral end 7, respectively, of the motor housing 1. Each casing 6 forms a lateral flange extending longitudinally forwards and rearwards of the motor casing 1, so as to form a rigid, overall H-shaped frame 72, on which the other members of the apparatus are mounted and fixed, namely a top hood 5, an actuating handle 8; a front transverse wall 9 and a rear transverse wall 10, which extend between the two casings 6 and the top hood 5, and at the front and rear, respectively, of the motor housing 1 and delimit between them and with the casings 6, at their bottom part, a bottom opening closed by a base 11 provided with water inlets 66 having valves allowing the water to enter upwards but preventing it from being evacuated downwards. The base 11 bears a filtering bag 12 incorporated in the enclosure 73 thus formed by the hood 5, the transverse walls 9, 10 and the casings 6. The filtering bag 12 has two pockets extending at the front and rear, respectively, of the motor housing 1, between the motor housing and each transverse wall 9, 10.

The front transverse wall 9 and rear transverse wall 10 are provided, at their bottom part, with nonreturn drain valves 74 adapted to prevent the water from entering the enclosure 73 from outside during the operation of the apparatus but to allow the water contained in the enclosure 73 to leave, owing to gravity. When the propeller 3 is not active, the water contained in the enclosure 73 is automatically emptied owing to gravity via the drain valves 74 when the apparatus is taken out of the water.

In terms of running members, the apparatus comprises two front rollers 13 (a left-hand front roller and a right-hand front roller), extending between the two casings 6, and at the front of the front transverse wall 9, outside the hydraulic circuit formed in the enclosure 73, and transversely and as an axial extension of each other, and rotatable around a transverse axis parallel to the surface on which they roll, each of these front running members 13 being coupled, respectively, to one of the lateral casings 6; and two rear rollers 14 (a left-hand rear roller and a right-hand rear roller) extending between the two casings 6 and at the rear of the rear transverse wall 10, outside the hydraulic circuit formed in the enclosure 73, and transversely and as an axial extension of each other, and rotatable around a transverse axis parallel to the surface on which they roll, each of these rear running members 14 being coupled, respectively, to one of the lateral casings 6. The two rollers of the same pair of front rollers 13 or rear rollers 14 are independent of each other, in terms of rotation, that is to say not locked in terms of rotation, each of them being driven by one of the motors 83 (left-hand or right-hand), to the driving shaft 2 (left-hand or right-hand) of which it is connected by a transmission casing 6.

Each roller 13, 14 comprises a cylindrical main shaft 17, and a peripheral covering 18, for example made of foam and/or formed of brushes, which is mounted so as to be locked in terms of rotation with the shaft 17, but can be replaced in the event of wear. The shafts 17 of the two front rollers 13 or rear rollers 14 are cylinders of revolution and axially telescopic in each other so as to be able to be brought closer together at the central part of the apparatus in order to be uncoupled from the lateral casings 6 and demounted from the apparatus, or, on the contrary, to be spaced out from each other so as to couple them to the casings 6. The shafts 17 of the rollers 13, 14 are also guided by a central bearing 15, 16 integral with the front wall 9 and arranged between the two front rollers 13 or rear rollers 14. This bearing 15, 16 comprises a cutout 15 for receiving the shaft 17 having the larger diameter of the rollers 13, 14, and a locking hook 16 which pivots so as to be able to be swung above the cutout 15 and the shaft 17 for the mounting of the rollers or, on the contrary, moved away from the cutout 15 for the demounting of the rollers 13, 14. The two rear rollers 14 are similar to the front rollers 13, having a transverse axis parallel to that of the front rollers 13, and mounted and driven in a similar fashion to the front rollers 13. The bearings 15, 16 integral with the transverse walls 9, 10 and guiding the rollers 13, 14 are subjected to little radial force. The two rollers of the same pair are telescopic and therefore guided and held radially with respect to each other while being free in terms of rotation with respect to each other, and are also guided and held at their opposite ends by the casings 6.

The rollers 13, 14 define a running plane of the apparatus corresponding to the submerged surface on which they move. The driving shafts 2 of the apparatus are coaxial and parallel to this running plane. The pumping shaft 71 of the third motor driving the propeller 3 is orthogonal to this running plane, so that the propeller 3 is adapted to create a flow of water in the orthogonal direction moving away from the running plane (vertically upwards when the submerged surface is horizontal), from the bottom inlets 66 around the motor housing 1 and between the transverse walls 9, 10, the casings 6 and the motor housing 1, and up to a top evacuation orifice 4 made in the top hood 5 of the apparatus, through which the water is expelled upwards from the apparatus. The filtering bag 12 extends at the front and rear of the motor housing 1 and its opening is associated with the periphery of the base 11 so that this filtering bag 12 is interposed in the water circuit between the inlets 66 and the outlet orifice 4. The housing 1 can be moulded as close as possible around the motors 70, 83 and members which it contains, so as to achieve greater compactness, an increase in rigidity, and hydrodynamic rounded external shapes. When the propeller 3 is active, the water is driven in an upward movement and, therefore, cannot leave again via the drain valves 74 owing to gravity.

A watertight electrical supply cable 19 is connected to the inside of the motor housing 1, for supplying and controlling the different motors 70, 83, and this cable 19 passes through the top hood 5 via one of the apertures 79 for fixing the handle 8 so as to be able to be connected to an electric power supply outside the apparatus and the swimming pool.

The two lateral casings 6 are identical. In fact, each casing 6 is symmetrical with respect to a median transverse plane orthogonal to the running plane and therefore to the surface on which the apparatus moves. This plane of symmetry is thus, in particular, vertical when this surface is horizontal. The frame 72, and more generally the apparatus, are overall symmetrical with respect to the same median transverse plane orthogonal to the running plane, and this plane of symmetry of the robot coincides with the plane of symmetry of each casing 6. The frame 72 and the apparatus are also overall symmetrical with respect to a median longitudinal plane orthogonal to the running plane.

Each transmission casing 6 comprises an outer rigid housing 20 (the other elements of the casing 6 being incorporated in this housing 20). This housing 20 is formed of two half-shells 20*a*, 20*b*—an inner half-shell 20*a* closest to the motor housing 1 of the apparatus and fixed to the motor housing 1 of the apparatus, and an outer half-shell 20*b* farthest from the motor housing 1 of the apparatus. Each half-shell extends at least substantially orthogonally to the running plane and in the longitudinal direction, and the two half-shells 20*a*, 20*b* are mounted to each other at an overall longitudinal, peripheral plane 21*a*, 21*b*. The half-shells 20*a*, 20*b* are made of moulded rigid synthetic material.

The inner half-shell 20*a* comprises a median top bracket 22 extending transversely towards the centre of the apparatus so as to be able to be fixed by means of a screw 23 to the motor housing 1, above the driving shaft 2. The handle 8 has two ends 76, each of them being provided with a hook 77 capable of being engaged in an aperture 78 of the bracket 22 and hooked onto this bracket 22. The hood 5 is provided with apertures 79 allowing the hooks 77 to pass through the hood 5, and the insertion of locking clips 80 adapted to lock the hooks 77 in the hooking position. Each aperture 79 of the hood 5 is larger than the hook 77, so that a locking clip 80 may be inserted into this aperture 79 at the rear of the hook 77, between the hook 77 and the opposite edge of the aperture 79 in order to push the hook 77 back laterally into the position in which it is hooked onto the bracket 22. To remove the handle 8, it is thus necessary to remove the locking clips 80 by withdrawing them axially from the apertures 79 of the hood 5, thereby allowing the hooks 77 to be pushed back laterally in the apertures 78 of the brackets 22 and in the apertures 79 of the hood 5, in order to disengage them from the brackets 22 and then withdraw them axially from these apertures 78, 79. To refit the handle 8, the operations are performed in reverse.

The handle 8 is thus demountably fixed on the brackets 22 of the casings 6, and therefore on the frame 72, through the hood 5. It should be noted that this fixing of the handle 8 to the frame 72 also secures the hood 5 to the frame 72, the hooks 77 and clips 80 having an outer part larger than the apertures 79 of the hood 5 so that the hood 5 is held against the brackets 22 of the casings 6.

The inner half-shell 20*a* also comprises two bottom lateral brackets 24 which also extend transversely towards the centre of the apparatus in order to be placed above a lateral bottom shoulder 25 of the motor housing 1 and to be fixed thereto by means of screws 26. Between the brackets 22, 24, the inner half-shell 20*a* is shaped so as to receive the lateral end 7 of the motor housing 1, the driving shaft 2 being able to be coupled to an input journal 27 of the casing 6 accessible via an aperture 43 passing through the inner half-shell 20*a*, axially opposite the driving shaft 2.

The input journal 27 is mounted so as to be freely rotatable with respect to the casing 6, between the two half-shells 20*a*, 20*b*, around a transverse axis of rotation, and receives the driving movement from the driving shaft 2. To this end, each half-shell 20*a*, 20*b* defines a cylindrical seat 28*a*, 28*b* which receives a ring 29*a*, 29*b*, made of synthetic antifriction material, which itself receives an axial cylindrical extension 306*a*, 30*b* of the input journal 27 allowing its rotational guidance in the ring 29*a*, 29*b*.

The cylindrical axial extension 30*a* extending from the side of the inner half-shell 20*a* is extended by means of four positive-locking pins 31 forming means for demountable coupling to the driving shaft 2. The driving shaft 2 is itself provided with a positive-locking cross 32 adapted to receive the positive-locking pins 31 of the input journal 27 when the casing 6 is in place on the motor housing 1. The positive-locking pins 31 and cross 32 thus produce means for demountable coupling by simple relative movement into place, of the positive clutch type, the axially extending pins 31 engaging in mating cutouts of the cross 32.

The casing 6 also comprises two output journals 33, 34, namely a front output journal 33 and a rear output journal 34, adapted to be coupled, through the housing 20, to the shaft 17 of one of the front rollers 13 or rear rollers 14, respectively. Each output journal 33, 34 is freely rotatable around a transverse axis of rotation, like the input journal 27. The front output journal 33 and rear output journal 34 are identical to the input journal 27 and are guided with respect to the housing 20 of the casing 6, like the input journal, by means of front cylindrical seats 35*a*, 35*b* and rear cylindrical seats 36*a*, 36*b* formed in the half-shells 20*a*, 20*b*, and front rings 37*a*, 37*b* made of antifriction material and rear rings 38*a*, 38*b* made of antifriction material, each output journal 33, 34 comprising a cylindrical axial extension 39*a*, 39*b* and 40*a*, 40*b*, respectively, which is engaged in the corresponding ring 37*a*, 37*b*, 38*a*, 38*b*. The two output journals 33, 34 also comprise, on the inner side of the apparatus, positive-locking pins 41 and 42, respectively, which are adapted for the coupling of the journal 33, 34 to a positive-locking cross 46 and 47, respectively, which extends at the opposite lateral axial end of the shaft 17 of the roller 13, 14. The positive-locking pins 31, 41, 42 of the different journals 27, 33, 34 extend through circular apertures 43, 44, 45 arranged through the inner half-shell 20*a* in order to be able to cooperate with the opposite positive-locking crosses 32, 46, 47 and provide the demountable coupling through the housing 20. The input journal 27 and output journals 33, 34 can be formed of identical components, thereby making it possible to reduce the manufacturing costs.

Between the input journal 27 and each of the output journals 33, 34, the casing 6 comprises a train of successive pinions 48, 49 meshed in pairs, mounted so as to be freely rotatable around transverse axes of rotation (parallel in pairs and to the axes of rotation of the journals 27, 33, 34), and meshed on the one hand with a toothed wheel 50 of the input journal 27 and on the other hand with a toothed wheel 51 and 52, respectively, of the output journal 33 and 34, respectively. Preferably, each train of pinions 48, 49 comprises an uneven number of pinions and the different pinions have the same diameter. The different pinions can thus be identical, in order to reduce the manufacturing costs. When the driving shaft 2 is coupled to the input journal 27, it drives it in rotation, and each of the output journals 33, 34 is also driven in rotation in the same direction and at the same speed by the trains of pinions 48, 49. The axes of rotation of the different pinions 48, 49 can be simply formed of cylindrical transverse extensions 53 adapted to receive a cylindrical bore of the different pinions, these extensions 53 extending outwards from the inner half-shell 20*a,* with which they are integral. Preferably, the inner half-shell 20*a* and outer half-shell 20*b* are joined to each other by screws 54 passing through the axes of rotation of the pinions 48, 49, that is to say through the transverse extensions 53. In this case, the different pinions 48, 49 have an aperture for the passage of these assembly screws 54, and the outer shell 20*b* comprises studs 55 which abut against the axial end of the transverse extensions 53 formed by the inner half-shell 20*a,* these studs 55 being adapted to receive the self-tapping screws 54, so that their threads are in engagement with these studs 55 which act as inside threads.

In a variant (not shown), or in combination, the studs 55 can be non-demountably secured (welding, adhesive bonding . . . ) to the extensions 53, the half-shells 21*a,* 20*a* then being incapable of being disassembled.

The inner half-shell 20*a* also comprises grooves 64 and 65, respectively, for receiving the lateral end edges 81 of the front transverse wall 9 and 82 of the rear transverse wall 10, and the bottom lateral brackets 62 are provided with apertures through which pass screws 63 allowing the assembly of the transverse walls 9, 10, the casings 6 and the hood 5. The transverse walls 9, 10 are therefore embedded in the grooves 64, 65 of the casings 6 and extend between these two casings 6 over the entire height of the casings 6 at the level of the grooves 64, 65. The screws 63 pull the transverse walls 9, 10 and the hood 5 towards each other on the casings 6. In the example shown, they are introduced into apertures of the transverse walls 9, 10 in order to be screwed into screwing studs forming inside threads of the hood 5.

The base 11 can be fixed on the transverse walls 9, 10 and/or the lateral casings 6 by screws and/or elastic hooks or other demountable fixing means so as to close the bottom opening formed by the transverse walls 9, 10 and the lateral casings 6. The base 11 is removably fixed to the frame 72, in particular to the lateral casings 6, by elastic hooks 75 cooperating with a groove 76 integral with the inner half-shell 20*a*. The transverse walls 9, 10 and the top hood 5 are carried by the casings 6 by means of the grooves 64, 65 and the brackets 62 and screws 63. To disassemble the apparatus, for example for a maintenance operation, it is sufficient to remove the rollers 13, 14 by bringing out the hooks 16, then removing the screws 63 and withdrawing the clips 80 in order to demount the handle 8. The transverse walls 9, 10 and the hood 5 can be dissociated from the frame 72. To demount the transverse walls 9, 10, it is necessary to demount one casing 6 (owing to the grooves 64, 65). The cable 19 passes through the hood and does not allow the complete separation of the hood 5 and the frame 72. Nevertheless, it is sufficient to slide the hood 5 along the cable 19, in order to enable an easy maintenance. Assembly is effected by performing the operations in reverse. The design of the apparatus may have numerous variants.

The outer half-shell 20*b* also preferably has a central top bracket 56 intended to extend above the central top bracket 22 of the inner half-shell 20*a* and fixed with it to the motor housing 1 above the driving shaft 2.

Furthermore, the casing 6 according to the invention advantageously comprises a crawler track 57 formed of an endless belt passing around the input journal 27 and output journals 33, 34 so as to be driven to continuously move along by means of these journals 27, 33, 34 and form a longitudinal bottom strand 58 for contact with the ground, serving as a running member driven by the apparatus. For guidance of the crawler track 57, each journal 27, 33, 34 advantageously comprises two lateral parallel flanges 59 perpendicular to the axis of rotation of the journal 27, 33, 34, on each side of the toothed wheel 50, 51, 52, so as to form a roller for receiving and driving the crawler track 57. The latter advantageously comprises inner notches or teeth 60 adapted to be inserted between the two flanges 59. Similarly, the crawler track 57 advantageously comprises outer notches or teeth 61, or any other equivalent antisliding member capable of abutting against the ground. Such a lateral crawler track facilitates the driving of the apparatus when passing over stairs or on changes of incline or on sloping walls.

The different pinions 48, 49, the journals 27, 33, 34 and the half-shells 20*a,* 20*b* can be produced entirely from rigid synthetic material, and the crawler track 57 from flexible synthetic material, so that the transmission casing 6 according to the invention is made entirely of synthetic material, with the possibly exception of the assembly screws 23, 26 (for mounting the casing 6 on the apparatus) and 54 for assembly of the half-shells 20*a,* 20*b*. These screws 23, 26, 54 may, however, also be produced from synthetic material. The whole of the transmission thus produced is not subject to corrosion and is highly reliable when operating in water. The apparatus according to the invention has no moving metal components or metal friction members. All the movable (rotary) elements necessary for the transmission of the driving movement from the driving shafts 2 to the running members (rollers 13, 14 and crawler track 57) are entirely incorporated in the two lateral casings 6 and carried by these casings 6. If one of the casings 6 requires a maintenance operation, it is easy to demount it from the apparatus and replace it with a new one, then to repair the casing in the workshop. During the repair operation, the apparatus remains operational in the swimming pool.

The different casings 6 are produced with a very small number of different components and their manufacturing cost is low. The same applies to the apparatus according to the invention.

The invention may have numerous variant embodiments other than the preferred embodiment shown both as regards the transmission casing(s) 6 and as regards the apparatus according to the invention. In particular, the transmission casing 6 can be applicable to a self-propelled apparatus whose drive motor is not electric but for example hydraulic. In the simplified versions, the transmission of the driving movement between the input journal 27 and each output journal 33, 34 may be effected solely via the crawler track 57 which serves as a drive belt (the casing in this case having no gear trains). The number of pinions of the gear trains may differ from three. The same applies to the number of output journal(s) which may differ from two (a single output journal or more than two output journals). The output journals may drive not rollers, but drive shafts locked in terms of rotation with wheels or rollers . . . or even be directly coupled to running members without a separate drive shaft (for example to end flanges of these wheels, rollers . . . ). The apparatus according to the invention may comprise running members which are not motorised (mounted free in terms of rotation) and/or running members coupled successively to one another and not directly independently to a transmission casing. An apparatus according to the invention may comprise only one drive motor, one driving shaft and one lateral transmission casing, the other lateral casing having no transmission means and serving only to guide the running members and, if appropriate, the crawler track. On the contrary, in the preferred illustrated version, the apparatus according to the invention comprises two drive motors 83, one on each side, and two lateral transmission casings 6, both provided with transmission means 48, 49, 57. In this case, it is possible to control the apparatus according to the speed of each motor 83.

The maintenance of the transmission of an apparatus according to the invention is reduced and simple. In the case of a deficient casing, it is sufficient to demount the so-called deficient transmission casing (that is to say on which a maintenance operation has to be carried out for preventive maintenance or because it has an operating deficiency (wear, rupture . . . )). To this end, it is sufficient to unscrew the screws 63 in order to dissociate the deficient casing 6 from the transverse walls 9, 10 and from the hood 5, and to withdraw the handle 8 and remove the screws 23, 26 in order to demount the casing 6 from the motor housing 1. A casing 6 in working order is remounted by the opposite operations to render the apparatus operational again. A new transmission casing 6 in working order different from the deficient casing (new or consisting of a repaired casing) may be immediately put in place, the apparatus being immediately operational without adjustment. The demounted casings 6 may be subject to one maintenance operation or several maintenance operations or may even be discarded.

The invention claimed is:

1. A self-propelling rolling swimming pool cleaning apparatus and transmission device for cleaning a submerged surface comprising a motor housing (1) with at least one drive shaft (2) enclosed therein;

the transmission device, connected to the motor housing (1), transmitting the rotary driving movement of the at least one driving shaft (2), carried by the apparatus, to running members (13, 14, 57) rotatable around transverse axes of rotation in order to drive the apparatus in displacement, which device is formed of a lateral transmission casing (6) comprising:

a rigid housing (20), an input journal (27) mounted so as to be freely rotatable around an axis of rotation with respect to the rigid housing (20), and provided with means (31) for demountable coupling to the at least one driving shaft (2) of the apparatus, likewise the at least one drive shaft being provided with means (32) for demountable coupling mating with the demountable coupling means (31) of the input journal (27), this input journal (27) being adapted to be coupled to the at least one driving shaft (2) when the casing is mounted on the apparatus, at least one output journal (33, 34) mounted so as to be freely rotatable around a transverse axis of rotation with respect to the rigid housing (20), and provided with means (41, 42) for demountable coupling to a running member (13, 14), carried by the apparatus, rotatable around a transverse axis of rotation, outside the casing (6), the said running member (13, 14) likewise being provided with means (46, 47) for demountable coupling mating with the demountable coupling means of the output journal (33, 34), this output journal (33, 34) being adapted to be coupled to the said running member (13, 14) when the casing (6) is mounted on the apparatus, means (48, 49, 57) for transmission of the rotary driving movement between the input journal (27) and each output journal (33, 34), the rigid housing (20) bearing and guiding the journals (27, 33, 34) and the transmission means (48, 49, 57), and demountable mounting means (22 to 26) adapted to enable the rigid removable fixing, allowing mounting and demounting, of the casing (6) in a single-piece assembly on one side of the apparatus, the input journal (27) being coupled to the at least one driving shaft (2) and each output journal (33, 34) being coupled to a running member (13, 14).

2. A device as claimed in claim 1, wherein the transmission means include gear trains (48, 49).

3. A device as claimed in claim 1, wherein the transmission means comprise a train of successive pinions (48, 49) between the input journal (27), which comprises a toothed wheel (50) meshing with one of these pinions, and each output journal (33, 34), which also comprises a toothed wheel (51, 52) meshing with one of these pinions, and wherein each journal (27, 33, 34) and each pinion (48, 49) is mounted so as to be freely rotatable around an axle carried by the rigid housing (20).

4. A device as claimed in claim 3, wherein all the journals (27, 33, 34) and pinions (48, 49) are rotatable around transverse axes of rotation.

5. A device as claimed in claim 3, wherein the axes of rotation of the pinions (48, 49) are formed by the rigid housing (20).

6. A device as claimed in claim 3, wherein the rigid housing (20) is formed of two half-shells (20*a*, 20*b*) extending at least substantially perpendicularly to the axes of rotation of the output journals (33, 34) and in the longitudinal direction, one on each side of the journals (27, 33, 34) and transmission means (48, 49, 57), and mounted to each other at an overall longitudinal peripheral mounting plane (21*a*, 21*b*).

7. A device as claimed in claim 6, wherein the two half-shells (20*a*, 20*b*) are mounted to each other by means of screws and/or bolts (54) passing through the axle of the pinions (48, 49).

8. A device as claimed in claim 3, wherein the toothed wheel (50, 51, 52) of each journal (27, 33, 34) is interposed between the two flanges (59).

9. A device as claimed in one of claims 1 to 8, wherein each journal (27, 33, 34) is mounted so as to be freely rotatable with respect to the rigid housing (20) by means of two end bearings, each comprising a cylindrical seat (28*a*, 28*b*, 35*a*, 35*b*, 36*a*, 36*b*) formed by the rigid housing (20) and receiving a ring (29*a*, 29*b*, 37*a*, 37*b*, 38*a*, 38*b*) made of antifriction synthetic material which receives an axial cylindrical extension (30*a*, 30*b*, 39*a*, 39*b*, 40*a*, 40*b*) of the journal (27, 33, 34).

10. A device as claimed in claim 1, wherein the rigid housing (20), the journals (27, 33, 34) and the transmission means (48, 49, 57) are made of synthetic material.

11. A device as claimed in claim 1, wherein each journal (27, 33, 34) is mounted so as to be freely rotatable with respect to the rigid housing (20) by means of two end bearings, each comprising a cylindrical seat (28*a*, 28*b*, 35*a*, 35*b*, 36*a*, 36*b*) formed by the rigid housing (20) and receiving a ring (29*a*, 29*b*, 37*a*, 37*b*, 38*a*, 38*b*) made of antifriction synthetic material which receives an axial cylindrical extension (30*a*, 30*b*, 39*a*, 39*b*, 40*a*, 40*b*) of the journal (27, 33, 34).

12. A device as claimed in claim 1, which is overall in the shape of an isosceles triangle and comprises an input journal (27) at its median upper vertex, and an output journal (33, 34) at each of its front and rear lower vertices so as to couple them to front running members (13) and rear running members (14).

13. A device as claimed in claim 1, wherein the rigid housing (20) is an outer housing (20) enclosing and receiving the journals (27, 33, 34) and the said transmission means (48, 49, 57), and comprises, on the side oriented towards the centre of the apparatus, for each journal, an aperture (43, 44, 45) capable of enabling the coupling of this journal (27, 33, 34), through the rigid housing (20), to a driving shaft (2) or to a running member (13, 14).

14. A device as claimed in claim 1, wherein the means (31, 41, 42) for demountable coupling of each journal (27, 33, 34) are of the type producing the coupling with mating coupling means (32, 46, 47) of the at least one driving shaft (2) or of a running member (13, 14) by simple relative movement into place—in particular of the positive clutch type.

15. A device as claimed in claim 1, wherein the said demountable mounting means (22 to 26) include means for rigid assembly of the rigid housing (20) of the casing (6) with the motor housing (1) of the apparatus.

16. A device as claimed in one of claims 1 to 15, which bears at least one running member (57) of the apparatus.

17. A device as claimed in claim 1, wherein the said demountable mounting means (20 to 26) include clamping screws (23, 26) and/or bolts.

18. A device as claimed in claim 1, which bears at least one running member (57) of the apparatus.

19. A device as claimed in one of claims 1 to 18, wherein each journal (27, 33, 34) comprises two flanges (59) parallel to each other and perpendicular to the axis of rotation of the journal (27, 33, 34), and adapted to form a roller for receiving and driving the crawler track (57).

20. A device as claimed in one of claims 3 to 19, wherein the toothed wheel (50, 51, 52) of each journal (27, 33, 34) is interposed between the two flanges (59).

21. A device as claimed in claim 19, wherein the crawler track (57) is made of flexible synthetic material.

22. A device as claimed in claim 1, wherein each journal (27, 33, 34) comprises two flanges (59) parallel to each other and perpendicular to the axis of rotation of the journal (27, 33, 34), and adapted to form a roller for receiving and driving the crawler track (57).

23. A device as claimed in claim 1, wherein the rigid housing (20) is formed of two half-shells (20*a*, 20*b*) extending at least substantially perpendicularly to the axes of rotation of the output journals (33, 34) and in the longitudinal direction, one on each side of the journals (27, 33, 34) and transmission means (48, 49, 57), and mounted to each other at an overall longitudinal peripheral mounting plane (20*a*, 21*b*).

24. A self-propelled rolling apparatus for cleaning a submerged surface, comprising at least one driving shaft (2), running members (13, 14, 57) rotatable around transverse axes of rotation in order to drive the apparatus in displacement, and transmission means for transmitting the rotary driving movement of each driving shaft (2) to each running member (13, 14, 57), wherein the transmission means comprises at least one transmission device (6) as claimed in claim 1.

25. An apparatus as claimed in claim 24, which comprises two transmission devices (6), one on each side.

26. An apparatus as claimed in claim 25, which comprises:

a front transverse wall (9) and a rear transverse wall (10) extending between the two lateral transmission devices (6) at the front and rear at a distance from the motor housing (1) so as to provide a passage for the water, and to form a bottom opening, a base (11), provided with water inlets (66) and adapted to close the said bottom opening, and a top hood (5) covering the transverse walls (9, 10), the lateral transmission devices (6) and the motor housing (1), this hood (5) being provided with a top orifice (4) for the evacuation of water, so that a hydraulic circuit is provided from the inlets (66) of the base (11), at the front and rear between the transverse walls (9, 10) and the motor housing (1) and between the lateral devices (6), and up to the orifice (4) of the hood (5).

27. An apparatus as claimed in claim 26, wherein the motor housing (1) is moulded as close as possible around the elements which it contains and has rounded shapes promoting the water circulation.

28. An apparatus as claimed in one of claims 25 and 26, wherein the motor housing (1) comprises an upper central motor, its shaft being orthogonal to the running plane and driving a pumping propeller (3) arranged outside the motor housing (1) under the orifice (4) of the hood (5), and capable of generating a flow of water in the apparatus.

29. An apparatus as claimed in claim 27, wherein the base (11) bears a filter (12) interposed in the water circuit between the inlets (66) of the base (11) and the drain orifice (4) of the hood (5).

30. An apparatus as claimed in claim 26, wherein the motor housing (1) comprises an upper central motor, its shaft being orthogonal to the running plane and driving a pumping propeller (3) arranged outside the motor housing (1) under the orifice (4) of the hood (5), and capable of generating a flow of water in the apparatus.

31. An apparatus as claimed in claim 25, which comprises two independent separate motors, each of these motors having a driving shaft (2) coupled to one of the two transmission devices (6).

32. An apparatus as claimed in claim 25, which comprises two pairs of independent running members (13, 14), namely a front pair of running members (13) and a rear pair of running members (14), the two running members of the same pair being arranged as a coaxial extension of each other, one of them being coupled to one of the two transmission devices (6), while the other is coupled to the other transmission device (6).

33. An apparatus as claimed in claim 24, wherein each driving shaft (2) is rotatable about a transverse axis, and wherein the input journal (27) and the output journals (33, 34) of each transmission device are rotatable around transverse parallel axes, these different axes being at least substantially parallel to a running plane defined by the running members (13, 14, 57).

34. A method for maintaining the transmission of an apparatus as claimed in claim 24, wherein:

at least one lateral transmission casing (6), called a deficient casing (6), on which a maintenance operation is to be carried out, is demounted from the apparatus, a transmission casing (6) in working order is counted on the apparatus, in place of each deficient casing, to make the apparatus operational.

35. A method as claimed in claim 34, wherein, immediately after demounting at least one deficient casing (6), a different new transmission casing in working order is mounted as a replacement of each previously demounted deficient casing, in order to immediately make the apparatus operational.

* * * * *